United States Patent [19]

Seath

[11] 4,257,602

[45] Mar. 24, 1981

[54] ROLLING DISK GAME

[76] Inventor: Robert J. Seath, 303 Charbridge, Lapeer, Mich. 48446

[21] Appl. No.: 945,612

[22] Filed: Sep. 25, 1978

[51] Int. Cl.[3] ..... A63F 3/00

[52] U.S. Cl. ..... 273/126 R

[58] Field of Search ..... 273/118 R, 119 R, 108, 273/119 A, 126 R, 126 A, 87 R, 180, 87 C, 87.2, 129 R, 177 R, 181 R, 85 R, 128 A

[56] References Cited

U.S. PATENT DOCUMENTS

| | | | |
|---|---|---|---|
| 161,983 | 4/1875 | Pierce | 273/118 R |
| 963,686 | 7/1910 | Cole | 273/126 A |
| 1,906,025 | 4/1933 | Van Steenkiste | 273/126 R |
| 2,199,016 | 4/1940 | Watkins | 273/108 |
| 2,252,451 | 8/1941 | Anderson | 273/108 |
| 3,073,599 | 1/1963 | Best | 273/108 |
| 3,138,384 | 6/1964 | Irwin | 273/128 A |
| 3,268;227 | 8/1966 | Thatcher | 273/108 |
| 3,817,529 | 6/1974 | Dobbins | 273/128 A |
| 3,913,915 | 10/1975 | Carmen | 273/180 |
| 4,093,222 | 6/1978 | Eshleman | 273/87 R |

FOREIGN PATENT DOCUMENTS

| | | | |
|---|---|---|---|
| 87178 | 8/1936 | Sweden | 273/126 R |
| 3803 | of 1909 | United Kingdom | 273/108 |
| 227525 | 10/1923 | United Kingdom | 273/126 R |

*Primary Examiner*—Richard C. Pinkham
*Assistant Examiner*—T. Brown
*Attorney, Agent, or Firm*—Harry R. Dumont

[57] ABSTRACT

A board played game with the playing board elevated at one end. A pair of score boards are positioned each at a different side of the board with sectors having different numbered indicia in staggered order. The score boards are sized such that their surface is below the upper surface of the board and when the disk rolls over the edge onto each board it will stabilize and take position on one of the marked sectors. Also included on the board is a pair of pegs positioned proximate the lower end by the score boards. The players may be allowed at least three rolls at the bonus pegs which carry a much larger value than the several indicia indicated on the scoreboard.

4 Claims, 6 Drawing Figures

ROLLING DISK GAME

BACKGROUND OF THE INVENTION

This invention relates to an improved game apparatus which is a game of skill rather than one of chance. In the game, there are at least two players and each alternates in playing with all of the disks left in place until the game is completed. In this manner the players can elevate their score, for example, by hitting one disk with another and this calls for a much higher degree of skill than most target and roll games. Furthermore, each player has an opportunity to greatly add to his score by the more difficult task of passing the disks between the pair of pegs which are spaced just sufficiently to allow them to roll through with the most accurate placement. The disk itself is so sized and constructed that as soon as it passes over the edge of the playing board it will assume on the score board a stable, flat position.

Prior art games are known in which rolling projectiles of the type used in the present game are sent along an inclined rail with the distance travelled indicating a particular score. A game of this type is shown and disclosed in C. A. Watkins, U.S. Pat. No. 2,199,016 issued on Apr. 30, 1940 for "Game". Other games are known in which a disk shaped projectile is used for knocking game pieces from positions in the field of the board such as O. D. Sorell, U.S. Pat. No. 1,666,474, issued Apr. 17, 1928 for "Game Board for Game Pieces and Surface Projectiles". Other games are known of the type in which a spinning projectile is utilized which projectile falls off an edge formed in the game board such that it will drop into a numbered opening pocket to achieve a particular score. Such a game is shown and described in W. Zolper, U.S. Pat. No. 1,127,345 issued on Feb. 2, 1915 for "Game". A still different type of game is shown and disclosed in W. N. Best, U.S. Pat. No. 3,073,599 issued on Jan. 15, 1963 for "Rolling Game" in which the cylindrical type rolling projectile is upended by a rail in such manner that it drops on an indicia marked sector.

The present invention considered in the light of the prior art will be seen to involve much more of the element of skill than the element of chance. This makes the game much more interesting for the players.

BRIEF SUMMARY OF THE INVENTION

This invention relates to a rolling disk game in which a pair of score boards are positioned side-wise of the game board so that the rolling disks which drop off to each scoring board are caused to fall flat on the respective scoreboard.

BRIEF DESCRIPTION OF THE DRAWINGS

The present invention will be described in the accompanying specification and in the accompanying drawings in which like numerals refer to like elements and in which.

DETAILED DESCRIPTION OF THE PREFERRED EMBODIMENT

Figure 1:
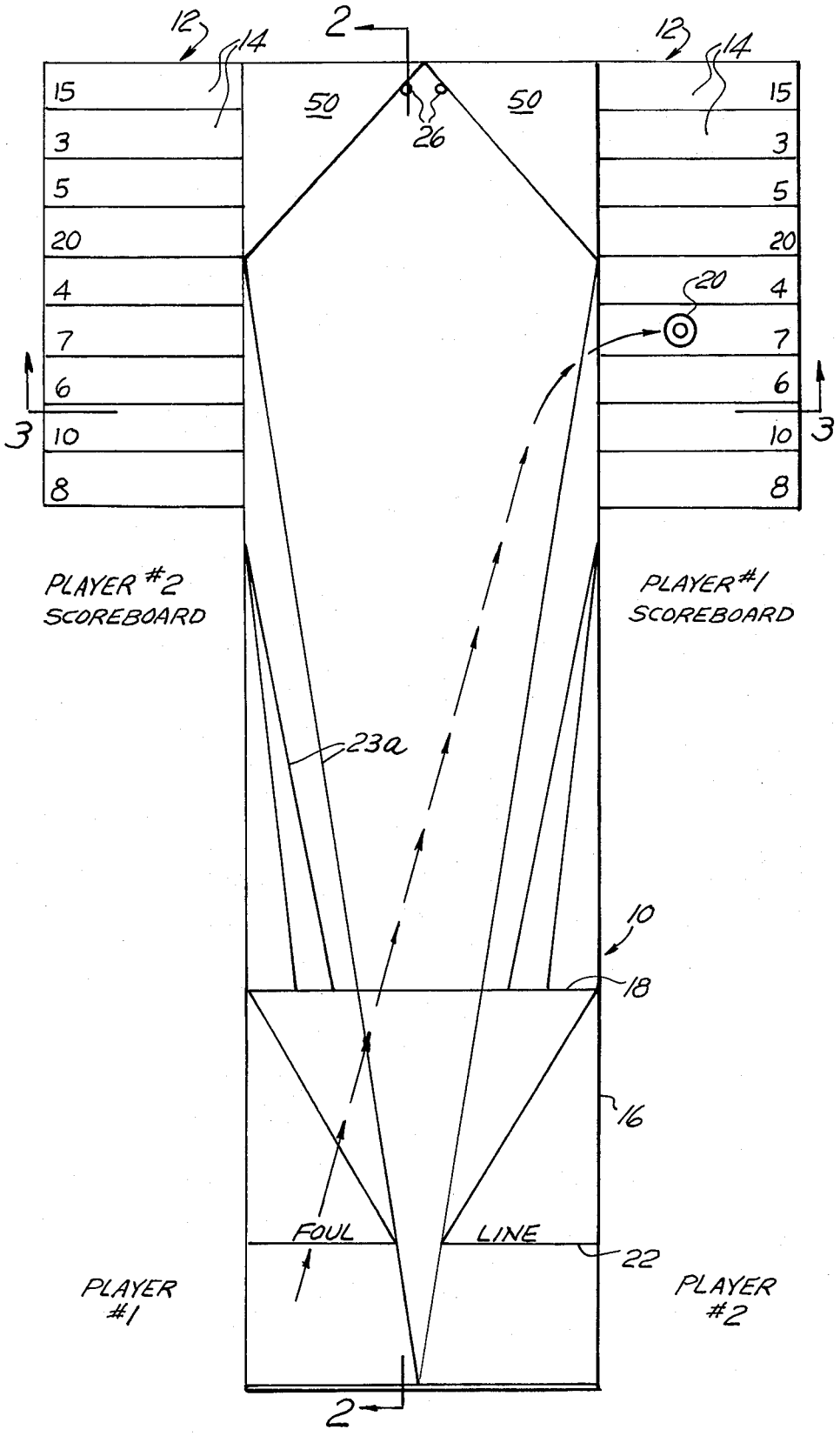
FIG. 1 is a top plan view of the apparatus used with the game.
Figure 2:
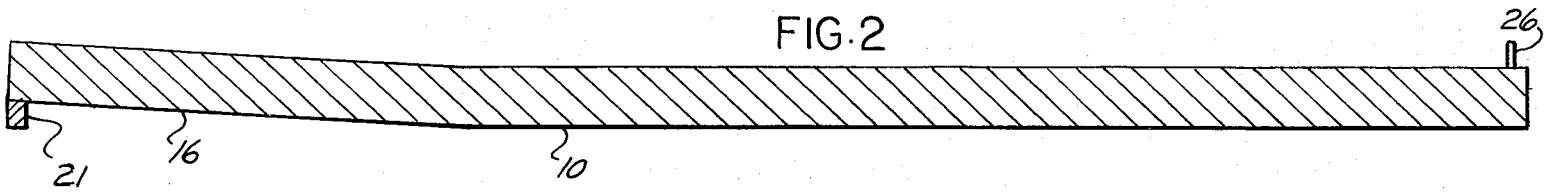
FIG. 2 is a longitudinal sectional view taken aong the section line 2—2 of FIG. 1.
Figure 3:
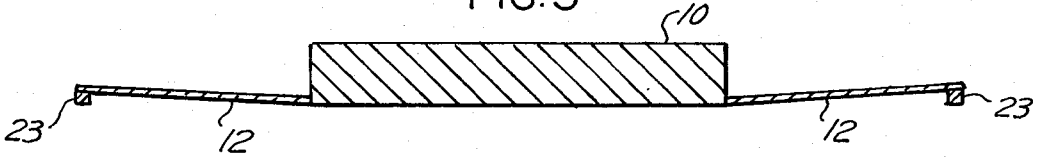
FIG. 3 is a tranverse sectional view taken along the line 3—3 of FIG. 1.

As best shown in FIGS. 1–3, the apparatus for my game includes a board 10 and a pair of score boards 12 located to either side of it. Each score board 12 includes a plurality of sectors 14, each bearing a different score indicia. These indicia are not in direct ascending or descending order but rather are staggered in value. The playing board 10 itself includes an elevated end 16 with a drop off along the line 18. This permits the disks 20 to be aimed from the foul line 22. Player assist and gravity will provide rolling of the disks 20 down a greater portion of the length of the playing board 10 and thence either to the right or to the left to select a value on the particular score board 12 at which the player is aiming. A plurality of lines 23 may be included on the surface of the playing board 10 in order to assist the players in sighting as they aim their disks 20 from behind the foul line 22. Also included at the end of the playing board 10 proximate the score boards 12 are a pair of pegs 26 which are upstanding and spaced by a distance just sufficient to allow a disk 20 to roll between them. It will be understood that the pegs and the successful rolling of a disk 20 by a player between them gives a bonus point to the player which is essentially higher in value than that assigned to one of the sectors 14 on the score board 12. For example, one bonus score which might be assigned to the pegs 26 is of the order of fifty points. The details of the game and clarification with respect to the manner in which it is played and the scores tallied will be clarified in the section "Description of Game Operation" hereinafter.

FIG. 2 clarifies the manner in which the one end 16 of the playing board 10 is elevated to allow proper downhill roll of each disk 20. This elevation is provided by a spacer rod 21 attached at the left hand end of the playing board 10.

Best shown in FIG. 3 is the detail of construction of the two score boards 12 which are removably positioned at the right and left hand sides of the playing board 10. It will further be seen that a pair of spacer rods 23 are attached to the outer edges of each scoreboard 12 so that when the several disks 20 are rolled down the playing board 10 and drop off onto the scoreboards 12 these will be caused to fall flat in a stable score indicating position rather than allowed to roll off the scoreboard outer edges.

Figure 6:
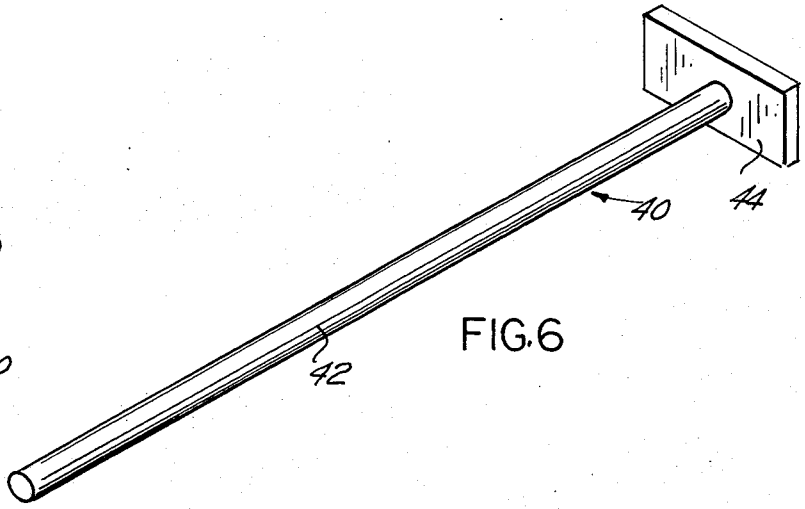
FIG. 6 is a perspective view of a rake which may be used with the game.
Figure 5:
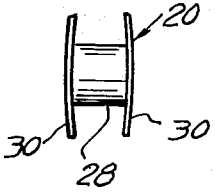
FIGS. 4 and 5 are elevated views showing the disk used in the game.
Figure 4:
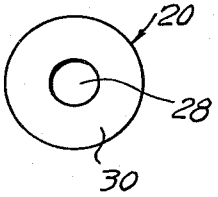

FIGS. 4 and 5 show the detail of each disk 20 which includes a central shaft 28 and a pair of side disks 30. I have found that only this configuration of disk projectile permits proper operation of the game. Otherwise stated, the center of gravity and shape of the disks are adapted for use in the game as other configurations are not. FIG. 6 shows a rake 40 with handle 42 and end portion 44 adapted to use to retrieve disks 20 from the score boards 12 after a game has been played.

DESCRIPTION OF GAME OPERATION

The object of my rolling disk game is for a player to score a 150 point total or as high a score as possible. Each player will be allowed a total of three disk rolls during his turn. The disks 20 must not be removed or touched until all three have been rolled. At that time, the score for each player is added. The players may alternate with respect to who gets the first turn. Each player is allowed a maximum of three rolls at the bonus pegs 26 during the game. He may thus choose when to roll for the bonus but must declare each time before he does so. Any disk which bounces off the pegs 26 onto the score board 12 does not count and must be removed. When a disk 20 passes between the pegs 26 it must go completely through and off the board 10 in order to tally.

Once a disk 20 is released from behind the foul line 22 a player cannot retrieve the disk even though it does not roll past the foul line 22. The winner of the prior game has the right to determine which side of the board he wishes to play from.

In the event a disk 20 falls equally on two different numbered sectors 14, he has the right to either roll over again or accept the lower number of the two involved. The disk cannot be removed after the three rolls are made until both players agree on the correct tally. Different colored board portions and lines 23*a* may be placed on the playing board 10 in order to assist the two players in sighting in making their rolls. Preliminary to playing, the slant of the board 10 may be adjusted for either fast or slow roll but both players must agree on the speed before the game may begin.

It will thus be seen that I have provided by my invention a novel and improved game of skill in which a player can determine his most accurate rolling range, speed, and angle for the disks 20. As skills are further developed, disks 20 already positioned on the scoreboard 12 can be bumped forward or backward to a higher score number.

I claim:

1. A rolling disk game comprising:

a playing board having one end elevated above the other;

a pair of scoring boards each attached to a different side of the lower end of the playing board;

each of said score boards having a plurality of sectors with different magnitude score indicia on each;

a rolling disk projectile operative to be rolled on its edge from the upper to the lower end of the playing board and then off the side of said playing board to a flat score indicating position on its disk surface on a respective score board; and wherein each of said scoreboards has its outer edge distal from said playing board elevated to a raised position.

2. The combination as set forth in claim 1 wherein each of said scoreboards includes said plurality of sectors with different value indicia staggered in order of magnitude.

3. The combination as set forth in claim 1 wherein a foul line for launching the disk projectile is located forwardly spaced from the elevated end of said playing board.

4. A rolling disk game comprising:

a playing board having one end elevated above the other;

a pair of scoring boards each attached to a different side of the lower end of the playing board;

each of said score boards having a plurality of sectors with different magnitude score indicia on each;

a rolling disk projectile operative to be rolled on its edge from the upper to the lower end of the playing board and then off the side of said playing board to a flat score indicating position on its disk surface on a respective score board; and wherein a pair of pegs spaced one from the other by a distance just greater than the width of the disk projectile are mounted at the lower end of the playing board for providing a further score responsive to a rolling of the disk therebetween.

* * * * *